US005328754A

United States Patent [19]

Yuyama et al.

[11] Patent Number: 5,328,754

[45] Date of Patent: Jul. 12, 1994

[54] THERMOSENSITIVE IMAGE TRANSFER INK SHEET

[75] Inventors: Takeshi Yuyama, Shizuoka; Keishi Taniguchi, Susono; Shigeyuki Harada, Mishima, all of Japan

[73] Assignee: Ricoh Company, Ltd., Tokyo, Japan

[21] Appl. No.: 16,957

[22] Filed: Feb. 12, 1993

[30] Foreign Application Priority Data

Feb. 13, 1992 [JP] Japan ..... 4-026812
Nov. 27, 1992 [JP] Japan ..... 4-318960

[51] Int. Cl.[5] ..... B41M 5/26

[52] U.S. Cl. ..... 428/212; 428/195; 428/413; 428/484; 428/488.1; 428/488.4; 428/913; 428/914

[58] Field of Search ..... 428/195, 207, 216, 336, 428/413, 484, 488.1, 488.4, 913, 914, 212

[56] References Cited

U.S. PATENT DOCUMENTS 4,600,628 7/1986 Ishii et al. ..... 428/484

*Primary Examiner*—Pamela R. Schwartz
*Attorney, Agent, or Firm*—Oblon, Spivak, McClelland, Maier & Neustadt

[57] ABSTRACT

A thermosensitive image transfer ink sheet is composed of a support and a thermofusible coloring layer formed on the support, which contains a coloring agent, an epoxy resin, a mercapto-group-containing compound serving as an epoxy resin crosslinking agent, and a tertiary amine or a salt thereof serving as a crosslinking reaction promoting agent. A thermal image transfer recording material is composed of a thermosensitive image transfer ink sheet, and an image receiving sheet to which images are to be transferred from the thermosensitive image transfer ink sheet. This thermosensitive image transfer ink sheet is composed of a support and a thermofusible coloring layer formed on the support, with the thermofusible coloring layer containing a coloring agent and one or two components selected from the group consisting of the epoxy resin, the mercapto-group-containing compound, and the tertiary amine or the salt thereof, while one or two components selected from the group consisting of the epoxy resin, the mercapto-group-containing compound, and the tertiary amine or the salt thereof which are not contained in the thermofusible coloring layer are contained in a surface portion of the image receiving sheet.

15 Claims, No Drawings

THERMOSENSITIVE IMAGE TRANSFER INK SHEET

BACKGROUND OF THE INVENTION

1. Field of the Invention

This invention relates to a thermosensitive image transfer ink sheet capable of producing images with excellent heat resistance, solvent resistance, and frictional resistance, suitable for printing bar code labels for use in FA (Factory Automation) which demands images with such properties. This invention also relates to a thermal image transfer recording material using the thermosensitive image transfer ink sheet in combination with an image receiving sheet.

2. Discussion of the Background

A conventional thermosensitive recording material has the shortcomings that printed images are vulnerable to the changes in the environmental conditions such as changes in ambient temperature and light, so that recorded information tends to be easily erased by the changes in such environmental conditions.

In sharp contrast to this, a thermosensitive image transfer ink sheet has the advantages over the conventional thermosensitive recording material that images can be printed on plain paper, printed images can be preserved for an extended period of time, and information documents prepared from the thermosensitive image transfer sheet by computers and word processors can be output at low costs and substantially noiselessly. Because of these fundamental features, a thermosensitive image transfer ink sheet has recently become rapidly popular.

In accordance with the development of FA, there is an active demand for a thermosensitive image transfer ink sheet provided not only with the above-mentioned fundamental features, but also with additional features such as excellent heat resistance, solvent resistance, and frictional resistance.

To meet this demand, it is required that a resin component in a thermofusible ink layer of a thermosensitive image transfer ink sheet be three dimensionally crosslinked. The simplest way for doing this may be, for example, crosslinking the entire resin components in a thermofusible ink layer before image transfer is carried out. However, in this method, a large amount of heat and time is required for crosslinking the entire resin components in the thermofusible ink layer, and when the temperature of the thermosensitive image transfer ink sheet is suddenly increased for such crosslinking, there is the risk that the thermosensitive image transfer ink sheet adheres to each other when rolled, that is, the so-called blocking occurs, and also there is the risk that many creases are formed on the surface of the thermosensitive image transfer sheet, which have adverse effects on the quality of printed images. Moreover, if the entire resin components in the thermofusible ink layer have already been crosslinked, a large amount of thermal printing energy is required to transfer the thermofusible ink to an image receiving sheet, so that it is difficult to increase the thermosensitivity of the ink sheet. Furthermore, it is difficult to perform instant image transfer by the application of a small amount of thermal energy to the ink sheet by use of a high-speed printer which is recently available.

In addition to the above, when the amount of energy applied to the thermosensitive transfer ink sheet is increased to obtain an image with a satisfactory density, there is the risk that hot wires in a thermal head are cut off while in use.

In order to eliminate the above-mentioned drawbacks, various studies have been made, which are directed to the achievement of instant crosslinking of resin components contained in a thermofusible ink layer of a thermosensitive image transfer ink sheet during image transfer.

These studies include, for instance, a method of containing a thermocrosslinking resin compound in a thermofusible ink layer of a thermosensitive image transfer ink sheet as disclosed in Japanese Laid-Open Patent Application 60-212389; a method of separating a thermosensitive ink layer into two layers, one layer containing a reactive polymeric compound, and the other layer containing a crosslinking agent, whereby the reactive polymeric compound is instantly three-dimensionally crosslinked by the thermal energy applied from a thermal head at image transfer as disclosed in Japanese Laid-Open Patent Application 63-254093; and a method of containing a photo-crosslinking initiator in a thermosensitive ink layer of an thermosensitive image transfer ink sheet, and instantly crosslinking resin components contained in the thermosensitive ink layer by the application of natural light or special light as disclosed in Japanese Laid-Open Patent Applications 60-132790 and 62-23784.

Additionally, there is a method of containing one of a crosslinking resin or a crosslinking agent in a thermofusible ink layer of a thermosensitive image transfer ink sheet, and containing the other in a surface portion of an image receiving sheet, and combining the thermosensitive image transfer ink sheet and the image receiving sheet when image transfer is carried out. This method is considered comparatively easier to separate the crosslinking resin from the crosslinking agent than the previously mentioned methods, so that a large number of studies have been made on this method.

A representative example of the above-mentioned method is disclosed in Japanese Laid-Open Patent Application 62-87389. In this method, a crosslinking agent such as isocyanate is contained in a surface portion of an image receiving sheet, and is crosslinked with one component of hot melt materials contained in a thermofusible ink layer of a thermosensitive image transfer ink sheet.

Another representative example of the above-mentioned method is disclosed in Japanese Laid-Open Patent Application 2-41289, in which a polyol serving as a hardening polymer and isocyanate serving as a curing agent are separated, one in a thermofusible ink layer of a thermosensitive image transfer ink sheet and the other in an image receiving sheet.

Furthermore, Japanese Laid-Open Patent Application 63-212588 discloses a method of crosslinking a resin component in an ink layer of a thermosensitive image transfer ink sheet by use of a specific image receiving sheet which contains a micro-capsuled isocyanate and a thermoplastic polyol in a surface portion thereof.

In the method described in the previously mentioned Japanese Laid-Open Patent Application 60-212389, the thermofusible ink layer of the thermosensitive image transfer ink sheet comprises (a) a thermocrosslinking resin, which is composed of a combination of a blocked isocyanate which is blocked by a blocking agent such as acetylacetone or phenol, and a polyvalent active hydrogen-containing compound such as polyester polyol, or (b) a thermocrosslinking resin compound composed of a combination of epoxy resin and a micro-capsuled amine. These thermocrosslinking resin compounds, however, have the shortcoming that the crosslinking reaction is very slow. In the thermocrosslinking resin compound which contains the micro-capsuled amine, the particle diameter of the micro-capsuled amine is in the range of about 5 to 10 μm, so that the thermofusible ink layer tends to become significantly thick. In this case, there is also the shortcoming that the micro-capsules in the thermosensitive image transfer ink sheet are ruptured by the pressure applied thereto when the image transfer ink sheet is rolled for preservation, so that a crosslinking reaction is caused to take place in the thermosensitive image transfer ink sheet. The result is that the amount of thermal energy to be applied for thermal image transfer has to be increased.

In the method in the previously mentioned Japanese Laid-Open Patent Application 63-254093, a primary amine or an acid anhydride is employed as a crosslinking agent. In view of the reactivity of a primary amine, even when the crosslinking resin and the resin are separately contained in two ink layers of the thermosensitive image transfer ink sheet, respectively, it is difficult to consider that the resin and the crosslinking resin react at the interface between the two layers only during the thermal image transfer.

When an acid anhydride is employed, three dimensional crosslinking does not take place, but only linear crosslinking takes place, even if some crosslinking takes place, so that images with excellent heat resistance, solvent resistance, and frictional resistance cannot be obtained by the method disclosed in Japanese Laid-Open Patent Application 63-254093.

Furthermore, in the previously mentioned Japanese Laid-Open Patent Applications 60-132790 and 62-23784, the thermosensitive ink layer of the thermosensitive image transfer ink sheet contains a photocrosslinking initiator. However, when natural light is employed, at least half a day will be required for crosslinking resin components contained in the thermosensitive ink layer. In order to perform the instant crosslinking after thermal transfer, a special printer provided with a special light source is indispensable. Therefore, this method is not suitable for general use.

In the method disclosed in the previously mentioned Japanese Laid-Open Patent Application 62-87389, a crosslinking agent for one component of hot melt materials in the thermosensitive image transfer ink layer is contained in a surface portion of an image receiving sheet. However, if a crosslinking agent such as a primary amine or acid anhydride is employed, in view of the reactivity thereof, such a crosslinking agent in the surface portion of the image receiving sheet will deteriorate during preservation for an extended period of time, so that the effect of the crosslinking agent will be significantly decreased when used in practice.

Furthermore, when a hardening polymer and a curing agent are merely separated, one in a thermofusible ink layer of a thermosensitive image transfer ink sheet and the other in an image receiving sheet, as described in Japanese Laid-Open Patent Application 2-41289, if the separation of the hardening polymer from the curing agent is satisfactory, the curing agent such as an isocyanate compound is extremely unstable, and easily reacts with water in air so that the curing agent itself is crosslinked. Therefore, it is not considered that sufficient isocyanate groups for reacting with polyethylene-vinyl acetate copolymer with hydroxyl groups remain at thermal image transfer.

As disclosed in Japanese Laid-Open Patent Application 63-212588, when a micro-capsuled isocyanate and a thermoplastic polyol are contained in a surface portion of an image receiving sheet, the microcapsules will be ruptured by the pressure applied by a platen roller during printing, so that the crosslinking of the thermoplastic polyol takes place on the surface of the image receiving sheet. Thus, there is the risk that no components from a thermosensitive image transfer ink sheet are fixed to the image receiving sheet, without forming any clear images.

Furthermore, Japanese Patent Publication 60-59159 discloses a method of controlling the softening point of a constituent resin in an ink layer of a thermosensitive image transfer ink sheet by using an epoxy resin with a softening point of 60° C. to 110° C. and a coloring agent in combination. However, images printed on an image receiving sheet come off when rubbed at a temperature higher than 100° C.

SUMMARY OF THE INVENTION

Accordingly, a first object of the present invention is to provide a thermosensitive image transfer ink sheet free from the above-mentioned conventional shortcomings, and capable of producing images with high image density, excellent resistance to heat, solvents, chemicals and friction, with high thermosensitivity, even by the momentary application of a small amount of thermal energy thereto at high speed printing.

A second object of the present invention is to provide a thermal image transfer recording material capable of producing images with high image density, excellent resistance to heat, solvents, chemicals and friction, with high thermosensitivity, even by the momentary application of a small amount of thermal energy thereto at high speed printing.

The first object of the present invention can be achieved by a thermosensitive image transfer ink sheet comprising a support, and a thermofusible coloring layer formed on the support, comprising a coloring agent, an epoxy resin, a mercapto-group-containing compound serving as an epoxy resin crosslinking agent, and a tertiary amine or a salt thereof serving as a crosslinking reaction promoting agent.

Because of the above-mentioned structure of the thermosensitive image transfer ink sheet according to the present invention, the thermofusible coloring layer can be instantly three-dimensionally crosslinked only when thermal image transfer is carried out, whereby there can be avoided the conventional shortcomings of a conventional thermosensitive image transfer ink sheet, such as the decrease of the thermosensitivity caused by the crosslinking of the thermofusible coloring layer prior to thermal image transfer, and the necessity for a device and time for carrying out the crosslinking of the thermofusible coloring layer.

The second object of the present invention can be achieved by a thermal image transfer recording material comprising: (a) a thermosensitive image transfer ink sheet, and (b) an image receiving sheet to which images are transferred from the thermosensitive image transfer ink sheet, with the application of heat thereto, to form images on the image receiving sheet, the thermosensitive image transfer ink sheet comprising a support and a thermofusible coloring layer formed on the support, the thermofusible coloring layer comprising a coloring agent and one or two components selected from the group consisting of an epoxy resin, a mercapto-group-containing compound serving as an epoxy resin crosslinking agent, and a tertiary amine or a salt thereof serving as a crosslinking reaction promoting agent, and one or two components selected from the group consisting of the epoxy resin, the mercapto-group-containing compound, and the tertiary amine or the salt thereof which are not contained in the thermofusible coloring layer are contained in the surface of the image receiving sheet.

Because of the above-mentioned structure of the thermal image transfer recording material according to the present invention, the stability of the crosslinking can be maintained until thermal image transfer is carried out, and the instant three-dimensional crosslinking of the thermofusible coloring layer can be carried out at the surface of the image receiving sheet.

DETAILED DESCRIPTION OF THE PREFERRED EMBODIMENTS

A thermosensitive image transfer ink sheet according to the present invention comprises a support, and a thermofusible coloring layer formed on the support, comprising a coloring agent, an epoxy resin, a mercapto-group-containing compound serving as an epoxy resin crosslinking agent, and a tertiary amine or a salt thereof serving as a crosslinking reaction promoting agent.

The above-mentioned three components in the thermofusible coloring layer can be fused and instantly three-dimensionally crosslinked only by the application of a small amount of energy from a thermal printer.

The thermofusible coloring layer of the thermosensitive image transfer ink sheet according to the present invention may comprise two or three ink layers.

When the thermofusible coloring layer comprises two ink layers, it is preferable that the coloring agent be contained in at least one of the two ink layers, each of the epoxy resin and the mercapto-group-containing compound be contained in the different ink layers of the two ink layers, one in each ink layer, and the tertiary amine or the salt thereof be contained in at least one of the two ink layers.

A thermofusible material or a thermo-softening material may be included in the above ink layers. It is more preferable that the coloring agent be not contained in an ink layer adjacent to the support. In other words, it is more preferable that the coloring agent be contained in the second ink layer counted from the first ink layer which is situated adjacent to the support.

When the thermofusible coloring layer comprises three ink layers, it is preferable that the coloring agent be contained in at least one of the three ink layers, each of the epoxy resin, the mercapto-group-containing compound, and the tertiary amine or the salt thereof be contained in the different ink layers of the three ink layers, one in each ink layer. It is more preferable that the coloring agent be not contained in an ink layer adjacent to the support. In other words, it is more preferable that the coloring agent be contained in the second ink layer and/or the third ink layer counted from the first ink layer which is situated adjacent to the support.

A thermal image transfer recording material according to the present invention comprises (a) a thermosensitive image transfer ink sheet, and (b) an image receiving sheet to which images are to be transferred from the thermosensitive image transfer ink sheet, with the application of heat thereto, to form images on the image receiving sheet.

The thermosensitive image transfer ink sheet comprises a support and a thermofusible coloring layer formed on the support, and the thermofusible coloring layer comprises one or two components of an epoxy resin, a mercapto-group-containing compound serving as an epoxy resin crosslinking agent, and a tertiary amine or a salt thereof serving as a crosslinking reaction promoting agent.

One or two components selected from the group consisting of the epoxy resin, the mercapto-group-containing compound and the tertiary amine or the salt thereof which are not contained in the thermofusible coloring layer are contained in the surface of the image receiving sheet.

More specifically, there are the following thermal image transfer recording materials:

(i) A thermal image transfer recording material comprising a thermosensitive image transfer ink sheet comprising a thermofusible coloring layer which comprises the epoxy resin and the tertiary amine or the salt thereof, and an image receiving sheet comprising a mercapto-group-containing compound in a surface portion thereof.

(ii) A thermal image transfer recording material comprising a thermosensitive image transfer ink sheet comprising a thermofusible coloring layer which comprises the epoxy resin, and an image receiving sheet comprising the mercapto-group-containing compound and the tertiary amine or the salt thereof in a surface portion thereof.

(iii) A thermal image transfer recording material comprising a thermosensitive image transfer ink sheet comprising a thermofusible coloring layer which comprises the epoxy resin and the mercapto-group-containing compound, and an image receiving sheet comprising the tertiary amine or the salt thereof in a surface portion thereof.

(iv) A thermal image transfer recording material comprising a thermosensitive image transfer ink sheet comprising a thermofusible coloring layer which comprises the mercapto-group-containing compound, and an image receiving sheet comprising the epoxy resin and the tertiary amine or the salt thereof in a surface portion thereof.

(v) A thermal image transfer recording material comprising a thermosensitive image transfer ink sheet comprising a thermofusible coloring layer which comprises the mercapto-group-containing compound and the tertiary amine or the salt thereof, and an image receiving sheet comprising the epoxy resin in a surface portion thereof.

(vi) A thermal image transfer recording material comprising a thermosensitive image transfer ink sheet comprising a thermofusible coloring layer which comprises the tertiary amine or the salt thereof, and an image receiving sheet comprising the epoxy resin and the mercapto-group containing compound.

The epoxy resin, mercapto-group-containing compound, and tertiary amine or salt thereof are fused and three dimensionally crosslinked at the surface of the image receiving sheet when heat is applied to the thermal image transfer recording material for image transfer.

It is preferable that the epoxy resin for use in the present invention have two or more epoxy groups in its molecule, and have a softening point in the range of 40° C. to 160° C. Furthermore, it is preferable that the epoxy resin for use in the present invention have an epoxy equivalent of 50 to 500 (g/eq).

Examples of the epoxy resin for use in the present invention are novolak epoxy resin and bisphenol epoxy resin. Specific examples of the novolak epoxy resin include o-cresol novolak epoxy resin, phenol novolak epoxy resin, and brominated phenol novolak epoxy resin, and specific examples of the bisphenol epoxy resin include epoxy resins of bisphenol A, bisphenol F, and bisphenol S types.

An epoxy compound with a boiling point in the range of 80° C. to 200° C. may be employed in combination with the above-mentioned epoxy resins. An example of such an epoxy compound is neopentyl glycol diglycidyl ether.

The above-mentioned epoxy resins and epoxy compounds can be used, for example, as follows:

(1) An epoxy resin comprising a mixture of an epoxy resin component with a softening point or melting point of less than 60° C. and an epoxy resin component with a softening point or melting point of 111° C. or more. In this epoxy resin, it is preferable that the epoxy resin component with a softening point or melting point of less than 60° C. be contained in an amount of 5 wt. % to 35 wt % of the entire weight of the epoxy resin.

(2) An epoxy resin comprising a mixture of an epoxy resin component with a softening point or melting point in the range of 50° C. to 120° C. and an epoxy compound with a boiling point of 80° C. to 200° C. In this epoxy resin, it is preferable that the epoxy compound with a boiling point 80° C. to 200° C. be contained in an amount of 1 wt. % to 10 wt. % of the entire weight of the epoxy resin.

(3) When an epoxy resin with a softening point of less than 60° C. is used in a thermofusible coloring layer containing a coloring agent, it is preferable that the epoxy resin be contained in an amount of 25 wt. % to 55 wt. % of the entire weight of the thermofusible coloring layer from which the coloring agent is excluded.

It is preferable that the mercapto-group-containing compound for use in the present invention have two or more mercapto groups in the molecule and has a melting point in the range of 40° C. to 200° C.

Specific example of the mercapto-group-containing compound are 1,4-benzenedithiol, 1,4-dimercapto-2,3-butanediol, bis-{4-mercapto phenol} ether, 4,4'-thiodibenzenethiol, 2,5-dimethylcapto-1,3,4-thiadiazole, bis-{2-mercapto propyoxy ethoxy} biphenyl, and metho-2,3-dimercapto succinic acid.

It is preferable that the tertiary amine for use in the present invention have two nitrogen atoms in the molecule. Specific examples of the tertiary amine include 1,8-diazabicyclo {5,4,0}-7-undecene, 1,4-bis(2-hydroxyethyl)piperazine, triethylenediamine, 1,5-diazabicyclo{4,3,0}-5-nonene, pyrazine, tetramethyl pyrazine, quinazoline, 4-phenyl pyrimidine, 4-pyrrolidino pyridine, 4-piperidino pyridine, 1,7-phenanthroline, 5-methyl-1,10-phenanthroline, 1-methyl-2-phenylbenzimidazole, and tetramethylguanidine.

Moreover, examples of the salt of the tertiary amine for use in the present invention include salts of the above-mentioned tertiary amines obtained by use of phenol, octylic acid, p-toluenesulfonic acid, and formic acid.

Any thermofusible materials and thermo-softening materials which do not impair the image transfer performance of the thermosensitive image transfer ink sheet may be added to the thermofusible coloring layer, when necessary.

Specific examples of the thermofusible materials and thermo-softening materials are waxes such as paraffin wax, carnauba wax, microcrystalline wax, castor wax, beeswax, and sersine wax; low-molecular-weight polymeric materials such as low-molecular-weight polyethylene, rosin, petroleum resin, and terpene resin; higher fatty acids and derivatives thereof such as salts, metallic salts and esters of higher fatty acids, for example, stearic acid, palmitic acid, lauric acid, aluminum stearate, lead stearate, barium stearate, zinc stearate, zinc palmitate, methylhydroxy stearate, and glycerol monohydroxy stearate; olefin homopolymers and copolymers and derivatives thereof such as polyethylene, polypropylene, polyisobutylene, poly-4-fluoroethylene, ethylene-acrylic acid ester copolymer, and ethylene-vinyl acetate copolymer.

When the thermofusible coloring layer comprises an epoxy resin with a softening point of less than 60° C., it is preferable that a wax with a melting point of 75° C. or more be contained in the thermofusible coloring layer.

In a thermofusible coloring layer containing an epoxy resin, it is preferable that about 0 to 50 parts by weight of the above-mentioned thermofusible material or thermo-softening material be added to 100 parts by weight of the epoxy resin. If the amount of the thermofusible material or thermo-softening material exceeds 80 parts by weight to 100 parts by weight of the epoxy resin in the thermofusible coloring layer, the use of the thermofusible material or thermo-softening material is not effective.

Organic or inorganic dyes and pigments used for printing and dyeing can be employed as the coloring agent for use in the present invention, without any restriction to the color thereof. Examples of dyes that can be used as the coloring agent in the present invention are direct dyes, oil-soluble dyes, and basic dyes.

Specific examples of the above-mentioned dyes are carbon black, red iron oxide, Disazo Yellow, Brilliant Carmine 6B. Lake Red C, Fast Sky Blue, and Phthalocyanine Green. As mentioned previously, it is preferable that the coloring agent be contained in an ink layer which is not adjacent to the support.

Any materials with sufficient heat resistance and strength for successive printing operation can be employed as a material for the support of the thermosensitive image transfer ink sheet and the support used in the thermal image transfer recording material according to the present invention.

It is desirable to employ a support with a thickness in the range of 3 to 10 μm. Specific examples of the material for the support include plastic films made of a material such as polyester, polypropylene, cellophane, polycarbonate, cellulose acetate, polyethylene, polyvinyl chloride, polystyrene, nylon, polyimide, polyvinylidene chloride, polyvinyl alcohol, polyethylene terephthalate, and polyethylene naphthalate; condenser paper; and paraffin paper.

A back coat layer with appropriate lubricating properties and heat resistance may be provided on the back side of the support. Specific example of the material for the back coat layer include silicone resin, fluorine plastics, polyimide resin, phenolic resin, melamine resin, urethane resin, nitrocellulose, and modified resins of these. Moreover, it is desirable to select, as the material for the back coat layer, materials which do not react with the materials used in the thermofusible coloring layer, in view of the prevention of the blocking of the thermofusible coloring layer. This is because the blocking of the thermofusible coloring layer takes place if the thermosensitive image transfer ink sheet is rolled and the back coat layer is in contact with the thermofusible coloring layer for an extended period of time during the preservation thereof.

When the support for use in the present invention has appropriate lubricating properties and heat resistance, it is not necessary to provide the above-mentioned back coat layer.

For the fabrication of the thermosensitive image transfer ink sheet and the thermal image transfer recording material according to the present invention, in particular, the formation of the thermofusible coloring layer and other layers, a solvent coating method is preferably employed. More specifically, conventional coating methods such as reverse-roll coating, gravure coating, rod coating, air doctor coating, and blade coating can be employed for the above purpose. No special devices or facilities are necessary for these coating methods.

As a solvent employed for coating the thermofusible coloring layer and the back coat layer used in the present invention, any solvents which are convenient for dispersing each material contained in the thermofusible coloring layer and the back layer can be used. Specific examples of the solvent are alcohols such as methanol, ethanol, isopropyl alcohol, butanol and isobutanol; ketones such as methyl ethyl ketone, methyl isobutyl ketone and cyclohexanone; aromatic solvents such as toluene and xylene; halogen solvents such as dichloromethane and trichloroethane; esters such as ethyl acetate; dioxane; and tetrahydrofuran. These solvents can be used alone, or in combination with respect to similar solvents at a predetermined mixing ratio.

In the case where a back coat layer is provided on the back side of the support, it is preferable that the solvent used in the thermofusible coloring layer and the solvent for the back coat layer have different polarities in order to prevent the blocking between the back coat layer and the thermofusible coloring layer which are considered to be in contact for an extended period when preserved.

Other features of this invention will become apparent in the course of the following description of exemplary embodiments, which are given for illustration of the invention and are not intended to be limiting thereof.

EXAMPLE I-1

Preparation of Back Layer

A back coat layer was provided on a back side of a 4.5 μm thick polyethylene terephthalate film, serving as a support, by coating a silicone-modified urethane resin in an amount of 0.5 g/m$^2$.

Formation of First Ink Layer

The following components were dispersed in a sand mill at room temperature for 6 successive hours, whereby a coating liquid A for a first ink layer was obtained.

| | Parts by Weight |
|---|---|
| Carnauba wax | 200 |

-continued

| | Parts by Weight |
|---|---|
| 1,4-benzenedithiol (the number of mercapto groups in the molecule: 2; m.p. 98° C.) | 100 |
| Toluene | 400 |

The above prepared coating liquid A was coated on the front side of the support, opposite to the back coat layer with respect to the support and dried, whereby a first ink layer was formed with a deposition amount of 2.5±0.3 g/m$^2$ on the support.

Formation of Second Ink Layer

The following components were dispersed in a sand mill at room temperature for 6 successive hours, whereby a coating liquid B for a second ink layer was obtained.

| | Parts by Weight |
|---|---|
| Carbon black | 25 |
| O-cresol novolak epoxy resin (Trademark "EOCN-1020", made by Nippon Kayaku Co., Ltd.; softening point: 70.7° C.; epoxy equivalent: 199 g/eq) | 100 |
| 1,8-diazabicyclo {5,4,0} 7-undecene (the number of nitrogen atoms in the molecule: 2) | 20 |
| Methyl ethyl ketone | 400 |
| Methyl isobutyl ketone | 40 |

The above prepared coating liquid B was coated on the first ink layer and dried, whereby a second ink layer was formed with a deposition amount of 3.0±0.3 g/m$^2$ on the first ink layer, whereby a thermosensitive image transfer ink sheet No. I-1 according to the present invention was prepared.

EXAMPLE I-2

The procedure for preparation of the thermosensitive image transfer ink sheet No. 1-1 in Example I-1 was repeated except that the 1,8-diazabicyclo {5,4,0} 7-undecene in the coating liquid B employed in Example I-1 was replaced by 1,5-diazabicyclo {4,3,0}-5-nonene, whereby a thermosensitive image transfer ink sheet No. I-2 according to the present invention was prepared.

EXAMPLE I-3

The procedure for preparation of the thermosensitive image transfer ink sheet No. 1-1 in Example I-1 was repeated except that the 1,8-diazabicyclo {5,4,0} 7-undecene in the coating liquid B employed in Example I-1 was replaced by triethylenediamine, whereby a thermosensitive image transfer ink sheet No. I-3 according to the present invention was prepared.

EXAMPLE I-4

The procedure for preparation of the thermosensitive image transfer ink sheet No. 1-1 in Example I-1 was repeated except that the 1,4-benzenedithiol in the coating liquid A employed in Example I-1 was replaced by 4,4'-thiodibenzenethiol (the number of mercapto group: 2; m.p.: 116° C.), whereby a thermosensitive image transfer ink sheet No. I-4 according to the present invention was prepared.

EXAMPLE I-5

The procedure for preparation of the thermosensitive image transfer ink sheet No. 1-1 in Example I-1 was repeated except that the o-cresol novolak epoxy resin "EOCN-1020" (Trademark) in the coating liquid B employed in Example I-1 was replaced by brominated phenol novolak epoxy resin ("BREN-S" (Trademark), made by Nippon Kayaku Co., Ltd.) (softening point: 80° C.; epoxy equivalent: 280 g/eq), whereby a thermosensitive image transfer ink sheet No. I-5 according to the present invention was prepared.

COMPARATIVE EXAMPLE I-1

The procedure for preparation of the thermosensitive image transfer ink sheet No. I-1 in Example I-1 was repeated except that the 1,8-diazabicyclo {5,4,0} 7-undecene in the coating liquid B employed in Example I-1 was eliminated, whereby a comparative thermosensitive image transfer ink sheet No. 1-1 was prepared.

COMPARATIVE EXAMPLE I-2

The procedure for preparation of the thermosensitive image transfer ink sheet No. I-1 in Example I-1 was repeated except that the 1,8-diazabicyclo {5,4,0} 7-undecene in the coating liquid B employed in Example I-1 was replaced by benzyl dimethylamine having only one nitrogen atom in the molecule, whereby a comparative thermosensitive image transfer ink sheet No. I-2 was prepared.

COMPARATIVE EXAMPLE I-3

The procedure for preparation of the thermosensitive image transfer ink sheet No. I-1 in Example I-1 was repeated except that the 1,4-benzenedithiol in the coating liquid A employed in Example I-1 was eliminated, whereby a comparative thermosensitive image transfer ink sheet No. 1-3 was prepared.

COMPARATIVE EXAMPLE I-4

The procedure for preparation of the thermosensitive image transfer ink sheet No. I-1 in Example I-1 was repeated except that the 1,4-benzenedithiol in the coating liquid A employed in Example I-1 was replaced by 2-mercaptopyridine having only one mercapto group in the molecule (m.p. 128° C. to 130° C.), whereby a comparative thermosensitive image transfer ink sheet No. I-4 was prepared.

COMPARATIVE EXAMPLE I-5

The procedure for preparation of the thermosensitive image transfer ink sheet No. I-1 in Example I-1 was repeated except that the o-cresol novolak epoxy resin "EOCN-1020" (Trademark) in the coating liquid B employed in Example I-1 was replaced by paraffin wax, whereby a comparative thermosensitive image transfer ink sheet No. I-5 was prepared.

COMPARATIVE EXAMPLE I-6

The procedure for preparation of the thermosensitive image transfer ink sheet No. I-1 in Example I-1 was repeated except that the o-cresol novolak epoxy resin "EOCN-1020" (Trademark) in the coating liquid B employed in Example I-1 was replaced by an epoxy resin with a softening point of 200° C., whereby a comparative thermosensitive image transfer ink sheet No. I-6 was prepared.

EXAMPLE II-1

Preparation of thermosensitive image transfer ink sheet

Preparation of Back Layer

A back coat layer was provided on a back side of a 4.5 μm thick polyethylene terephthalate film, serving as a support, by coating a silicone-modified urethane resin in an amount of 0.5 g/m$^2$.

Formation of First Ink Layer

The following components were dispersed in a sand mill at room temperature for 6 successive hours, whereby a coating liquid C for a first ink layer was obtained.

| | Parts by Weight |
|---|---|
| Carnauba wax | 200 |
| 1,8-diazabicyclo {5,4,0}-7-undecene (the number of nitrogen atoms in the molecule: 2) | 20 |
| Toluene | 400 |

The above prepared coating liquid C was coated on the front side of the support, opposite to the back coat layer with respect to the support and dried, whereby a first ink layer was formed with a deposition amount of 2.5±0.3 g/m$^2$ on the support.

Formation of Second Ink Layer

The following components were dispersed in a sand mill at room temperature for 6 successive hours, whereby a coating liquid D for a second ink layer was obtained.

| | Parts by Weight |
|---|---|
| Carbon black | 25 |
| O-cresol novolak epoxy resin (Trademark "EOCN-1020", made by Nippon Kayaku Co., Ltd.; softening point: 70.7° C.; epoxy equivalent: 199 g/eq) | 100 |
| Methyl ethyl ketone | 400 |
| Methyl isobutyl ketone | 40 |

The above prepared coating liquid D was coated on the first ink layer and dried, whereby a second ink layer was formed with a deposition amount of 3.0±0.3 g/m$^2$ on the first ink layer, whereby a thermosensitive image transfer ink sheet No. II-1 was prepared.

Preparation of image receiving sheet

The following components were thoroughly dissolved, whereby a coating liquid E was prepared.

| | Parts by Weight |
|---|---|
| 1,4-benzenedithiol (the number of mercapto groups in the molecule: 2; m.p. 98° C.) | 100 |
| Methyl ethyl ketone | 400 |
| Methyl isobutyl ketone | 40 |

The above prepared coating liquid E was coated on a mirror coat paper and dried with a deposition amount of 1.0±0.3 g/m$^2$, whereby an image receiving sheet No. 1 for use with the above prepared thermosensitive image transfer ink sheet No. II-1 was prepared.

Thus, a thermal image transfer recording material No. II-1 composed of the thermosensitive image transfer ink sheet No. II-1 and the image receiving sheet No. 1 according to the present invention was obtained.

EXAMPLE II-2

The procedure for preparation of the thermosensitive image transfer ink sheet No. II-1 in Example II-1 was repeated except that 1,8-diazabicyclo {5,4,0} 7-undecene in the coating liquid C employed in Example II-1 was replaced by 1,5-diazabicyclo {4,3,0}-5-nonene, whereby a thermosensitive image transfer ink sheet No. II-2 was prepared.

The image receiving sheet No. 1 obtained in Example II-1 was employed in combination with the above thermosensitive image transfer ink sheet No. II-2.

Thus, a thermal image transfer recording material No. II-2 composed of the thermosensitive image transfer ink sheet No. II-2 and the image receiving sheet No. 1 according to the present invention was obtained.

EXAMPLE II-3

The procedure for preparation of the thermosensitive image transfer ink sheet No. II-1 in Example II-1 was repeated except that the 1,8-diazabicyclo {5,4,0} 7-undecene in the coating liquid C employed in Example II-1 was replaced by triethylenediamine, whereby a thermosensitive image transfer ink sheet No. II-3 according to the present invention was prepared.

The image receiving sheet No. 1 obtained in Example II-1 was employed in combination with the above thermosensitive image transfer ink sheet No. II-3.

Thus, a thermal image transfer recording material No. II-3 composed of the thermosensitive image transfer ink sheet No. II-3 and the image receiving sheet No. 1 according to the present invention was obtained.

EXAMPLE II-4

The thermosensitive image transfer ink sheet No. II-1 obtained in Example II-1 was employed.

The procedure for preparation of the image receiving sheet No. 1 in Example II-1 was repeated except that the 1,4-benzenedithiol in the coating liquid E employed in Example II-1 was replaced by 4,4'-thiodibenzenethiol (the number of mercapto groups: 2; m.p. 116° C.), whereby an ink sheet No. 2 was prepared.

Thus, a thermal image transfer recording material No. II-4 composed of the thermosensitive image transfer ink sheet No. II-1 and the image receiving sheet No. 2 according to the present invention was obtained.

EXAMPLE II-5

The procedure for preparation of the thermosensitive image transfer ink sheet No. II-1 in Example II-1 was repeated except that the o-cresol novolak epoxy resin "EOCN-1020" (Trademark) in the coating liquid D employed in Example II-1 was replaced by brominated phenol novolak epoxy resin "BREN-S" (Trademark), made by Nippon Kayaku Co., Ltd. (softening point: 80° C.; epoxy equivalent: 280 g/eq), whereby a thermosensitive image transfer ink sheet No. II-4 was prepared.

The image receiving sheet No. 1 obtained in Example II-1 was employed in combination with the above thermosensitive image transfer ink sheet No. II-4.

Thus, a thermal image transfer recording material No. II-5 composed of the thermosensitive image transfer ink sheet No. II-4 and the image receiving sheet No. 1 according to the present invention was obtained.

EXAMPLE II-6

The thermosensitive image transfer ink sheet No. II-1 obtained in Example II-1 was employed.

The procedure for preparation of the image receiving sheet No. 1 in Example II-1 was repeated except that the 1,4-benzenedithiol in the coating liquid E employed in Example II-1 was replaced by bis-{2-mercapto propyoxy ethoxy} biphenyl (the number of mercapto groups: 2; m.p. 83° C.), whereby an image receiving sheet No. 3 was prepared.

Thus, a thermal image transfer recording material No. II-6 composed of the thermosensitive image transfer ink sheet No. II-I and the image receiving sheet No. 3 according to the present invention was obtained.

EXAMPLE II-7

The procedure for preparation of the thermosensitive image transfer ink sheet No. II-1 in Example II-1 was repeated except that the o-cresol novolak epoxy resin "EOCN-1020" (Trademark) in the coating liquid D employed in Example II-1 was replaced by phenol novolak epoxy resin "EPPN-201" (Trademark), made by Nippon Kayaku Co., Ltd. (softening point: 68° C.; epoxy equivalent: 187 g/eq), whereby a thermosensitive image transfer ink sheet No. II-5 was prepared.

The image receiving sheet No. 1 obtained in Example II-1 was employed in combination with the above thermosensitive image transfer ink sheet No. II-5.

Thus, a thermal image transfer recording material No. II-7 composed of the thermosensitive image transfer ink sheet No. II-5 and the image receiving sheet No. 1 according to the present invention was obtained.

EXAMPLE II-8

Preparation of thermosensitive image transfer ink sheet

Preparation of Back Layer

A back coat layer was provided on a back side of a 4.5 μm thick polyethylene terephthalate film, serving as a support, by coating a silicone-modified urethane resin in an amount of 0.5 g/m$^2$.

Formation of First Ink Layer

The following components were dispersed in a sand mill at room temperature for 6 successive hours, whereby a coating liquid F for a first ink layer was obtained.

| | Parts by Weight |
|---|---|
| Carnauba wax | 200 |
| 1,4-benzenedithiol (the number of mercapto groups in the molecule: 2; m.p. 98° C.) | 100 |
| Toluene | 400 |

The above prepared coating liquid F was coated on the front side of the support, opposite to the back coat layer with respect to the support and dried, whereby a first ink layer was formed with a deposition amount of 2.5±0.3 g/m$^2$ on the support.

Formation of Second Ink Layer

The following components were dispersed in a sand mill at room temperature for 6 successive hours, whereby a coating liquid G for a second ink layer was obtained.

| | Parts by Weight |
|---|---|
| Carbon black | 25 |
| O-cresol novolak epoxy resin (Trademark "EOCN-1020", made by Nippon Kayaku Co., Ltd.; softening point: 70.7° C.; epoxy equivalent: 199 g/eq) | 100 |
| Methyl ethyl ketone | 400 |
| Methyl isobutyl ketone | 40 |

The above prepared coating liquid G was coated on the first ink layer and dried, whereby a second ink layer was formed with a deposition amount of 3.0±0.3 g/m$^2$ on the first ink layer, whereby a thermosensitive image transfer ink sheet No. II-6 was prepared.

Preparation of image receiving sheet

The following components were thoroughly dissolved, whereby a coating liquid H was prepared.

| | Parts by Weight |
|---|---|
| 1,8-diazabicyclo {5, 4, 0}-7-undecene (the number of nitrogen atoms in the molecule: 2) | 20 |
| Methyl ethyl ketone | 400 |
| Methyl isobutyl ketone | 40 |

The above prepared coating liquid H was coated on a mirror coat paper and dried with a deposition amount of 1.0±0.3 g/m$^2$, whereby an image receiving sheet No. 4 for use with the above prepared thermosensitive image transfer ink sheet No. II-6 was prepared.

Thus, a thermal image transfer recording material No. II-8 composed of the image transfer ink sheet No. II-6 and the image receiving sheet No. 4 according to the present invention was obtained.

EXAMPLE II-9

The thermosensitive image transfer ink sheet No. II-6 obtained in Example II-8 was employed.

The procedure for preparation of the image receiving sheet No. 4 in Example II-8 was repeated except that the 1,8-diazabicyclo {5,4,0} 7-undecene in the coating liquid H employed in Example II-8 was replaced by 1,5-diazabicyclo {4,3,0}-5-nonene, whereby an image receiving sheet No. 5 was prepared.

Thus, a thermal image transfer recording material No. II-9 composed of the thermosensitive image transfer ink sheet No. II-6 and the image receiving sheet No. 5 according to the present invention was obtained.

EXAMPLE II-10

The thermosensitive image transfer ink sheet No. II-6 obtained in Example II-8 was employed.

The procedure for preparation of the image receiving sheet No. 4 in Example II-8 was repeated except that the 1,8-diazabicyclo {5,4,0} 7-undecene in the coating liquid H employed in Example II-8 was replaced by triethylenediamine, whereby an image receiving sheet No. 6 was prepared.

Thus, a thermal image transfer recording material No. II-10 composed of the thermosensitive image transfer ink sheet No. II-6 and the image receiving sheet No. 6 according to the present invention was obtained.

EXAMPLE II-11

The procedure for preparation of the thermosensitive image transfer ink sheet No. II-6 in Example II-8 was repeated except that the 1,4-benzenedithiol in the coating liquid F employed in Example II-8 was replaced by 4,4'-thiodibenzenethiol (the number of mercapto groups: 2; melting point: 116° C.), whereby a thermosensitive image transfer ink sheet No. II-7 was prepared.

The image receiving sheet No. 4 obtained in Example II-8 was employed in combination with the above thermosensitive image transfer ink sheet No. II-7.

Thus, a thermal image transfer recording material No. II-11 composed of the thermosensitive image transfer ink sheet No. II-7 and the image receiving sheet No. 4 according to the present invention was obtained.

EXAMPLE II-12

The procedure for preparation of the thermosensitive image transfer ink sheet No. II-6 in Example II-8 was repeated except that the o-cresol novolak epoxy resin "EOCN-1020" (Trademark) in the coating liquid G employed in Example II-8 was replaced by a brominated phenol novolak epoxy resin "BREN-S" (Trademark), made by Nippon Kayaku Co., Ltd. (softening point: 80° C.; epoxy equivalent: 280 g/eq), whereby a thermosensitive image transfer ink sheet No. II-8 was prepared.

The image receiving sheet No. 4 obtained in Example II-8 was employed in combination with the above thermosensitive image transfer ink sheet No. II-8.

Thus, a thermal image transfer recording material No. II-12 composed of the thermosensitive image transfer ink sheet No. II-8 and the image receiving sheet No. 4 according to the present invention was obtained.

EXAMPLE II-13

The procedure for preparation of the thermosensitive image transfer ink sheet No. II-6 in Example II-8 was repeated except that the 1,4-benzenedithiol in the coating liquid F employed in Example II-8 was replaced by bis-{2-mercapto propyoxy ethoxy} biphenyl (the number of mercapto groups: 2; m.p. 83° C.), whereby a thermosensitive image transfer ink sheet No. II-9 was prepared.

The image receiving sheet No. 4 obtained in Example II-8 was employed in combination with the above thermosensitive image transfer ink sheet No. II-9.

Thus, a thermal image transfer recording material No. II-13 composed of the thermosensitive image transfer ink sheet No. II-9 and the image receiving sheet No. 4 according to the present invention was prepared.

EXAMPLE II-14

The procedure for preparation of the thermosensitive image transfer ink sheet No. II-6 in Example II-8 was repeated except that the o-cresol novolak epoxy resin "EOCN-1020" (Trademark) in the coating liquid G employed in Example II-8 was replaced by phenol novolak epoxy resin "EPPN-201" (Trademark), made by Nippon Kayaku Co., Ltd. (softening point: 68° C.; epoxy equivalent: 187 g/eq), whereby a thermosensitive image transfer ink sheet No. II-10 was prepared.

The image receiving sheet No. 4 obtained in Example II-8 was employed in combination with the above thermosensitive image transfer ink sheet No. II-10.

Thus, a thermal image transfer recording material No. II-14 composed of the thermosensitive image transfer ink sheet No. II-10 and the image receiving sheet No. 4 according to the present invention was obtained.

EXAMPLE II-15

Preparation of thermosensitive image transfer ink sheet

Preparation of Back Coat Layer

A back coat layer was provided on a back side of a 4.5 μm thick polyethylene terephthalate film, serving as a support, by coating a silicone-modified urethane resin in an amount of 0.5 g/m$^2$.

Formation of First Ink Layer

The following components were dispersed in a sand mill at room temperature for 6 successive hours, whereby a coating liquid I for a first ink layer was obtained.

| | Parts by Weight |
|---|---|
| Carnauba wax | 200 |
| 1,8-diazabicyclo {5,4,0}-7-undecene (the number of nitrogen atoms in the molecule: 2) | 20 |
| Toluene | 400 |

The above prepared coating liquid I was coated on the front side of the support, opposite to the back coat layer with respect to the support and dried, whereby a first ink layer with a deposition amount of 2.5±0.3 g/m$^2$ was formed on the support.

Formation of Second Ink Layer

The following components were dispersed in a sand mill at room temperature for 6 successive hours, whereby a coating liquid J for a second ink layer was obtained.

| | Parts by Weight |
|---|---|
| Carbon black | 25 |
| 1,4-benzenedithiol (the number of mercapto groups in the molecule: 2; m.p. 98° C.) | 100 |
| Methyl ethyl ketone | 400 |
| Methyl isobutyl ketone | 40 |

The above prepared coating liquid J was coated on the first ink layer and dried, whereby a second ink layer was formed with a deposition amount of 3.0±0.3 g/m$^2$ on the first ink layer, whereby a thermosensitive image transfer ink sheet No. II-11 was prepared.

Preparation of image receiving sheet

The following components were thoroughly dissolved, whereby a coating liquid K was prepared.

| | Parts by Weight |
|---|---|
| O-cresol novolak epoxy resin (Trademark "EOCN-1020", made by Nippon Kayaku Co., Ltd.; softening point: 70.7° C.; epoxy equivalent: 199 g/eq) | 100 |
| Methyl ethyl ketone | 400 |
| Methyl isobutyl ketone | 40 |

The above prepared coating liquid K was coated on a mirror coat paper and dried with a depostion amount of 1.0±0.3 g/m$^2$, whereby an image receiving sheet No. 7 for use with the above prepared thermosensitive image transfer ink sheet No. II-11 was prepared.

Thus, a thermal image transfer recording material No. II-15 composed of the thermosensitive image transfer sheet No. II-11 and the image receiving sheet No. 7 according to the present invention was obtained.

EXAMPLE II-16

The procedure for preparation of the thermosensitive image transfer ink sheet No. II-11 in Example II-15 was repeated except that the 1,8-diazabicyclo {5,4,0} 7-undecene in the coating liquid I employed in Example II-15 was replaced by 1,5-diazabicyclo {4,3,0}-5-nonene, whereby a thermosensitive image transfer ink sheet No. II-12 was prepared.

The image receiving sheet No. 7 obtained in Example II-15 was employed in combination with the above thermosensitive image transfer ink sheet No. II-12.

Thus a thermal image transfer recording material No. II-16 composed of the thermosensitive image transfer ink sheet No. II-12 and the image receiving sheet No. 7 according to the present invention was obtained.

EXAMPLE II-17

The procedure for preparation of the thermosensitive image transfer ink sheet No. II-11 in Example II-15 was repeated except that the 1,8-diazabicyclo {5,4,0} 7-undecene in the coating liquid I employed in Example II-15 was replaced by triethylenediamine, whereby a thermosensitive image transfer recording material No. II-13 was prepared.

The image receiving sheet No. 7 obtained in Example II-15 was employed in combination with the above thermosensitive image transfer ink sheet No. II-13.

Thus, a thermal image transfer recording material No. II-17 composed of the thermosensitive image transfer ink sheet No. II-13 and the image receiving sheet No. 7 according to the present invention was obtained.

EXAMPLE II-18

The procedure for preparation of the thermosensitive image transfer ink sheet No. II-11 in Example II-15 was repeated except that 1,4-benzenedithiol in the coating liquid J employed in Example II-15 was replaced by 4,4'-thiodibenzenethiol (the number of mercapto groups: 2; m.p. 116° C.), whereby a thermosensitive image transfer ink sheet No. II-14 was prepared.

The image receiving sheet No. 7 obtained in Example II-15 was employed in combination with the above thermosensitive image transfer ink sheet No. II-14.

Thus, a thermal image transfer recording material No. II-18 composed of the thermosensitive image transfer ink sheet No. II-14 and the image receiving sheet No. 7 according to the present invention was obtained.

EXAMPLE II-19

The thermosensitive image transfer ink sheet No. II-11 obtained in Example II-15 was employed.

The procedure for preparation of the image receiving sheet No. 7 in Example II-15 was repeated except that o-cresol novolak epoxy resin "EOCN-1020" (Trademark) in the coating liquid K employed in Example II-15 was replaced by brominated phenol novolak epoxy resin "BREN-S" (Trademark), made by Nippon Kayaku Co., Ltd. (softening point: 80° C.; epoxy equivalent: 280 g/eq), whereby an image receiving sheet No. 8 was prepared.

Thus, a thermal image transfer recording material No. II-19 composed of the thermosensitive image transfer ink sheet No. II-11 and the image receiving sheet No. 8 according to the present invention was obtained.

EXAMPLE II-20

The procedure for preparation of the thermosensitive image transfer ink sheet No. II-11 in Example II-15 was repeated except that 1,4-benzenedithiol in the coating liquid J employed in Example II-15 was replaced by bis-{2-mercapto propyoxy ethoxy} biphenyl (the number of mercapto groups: 2; m.p. 83° C.), whereby a thermosensitive image transfer ink sheet No. II-15 was prepared.

The image receiving sheet No. 7 obtained in Example II-15 was employed in combination with the above thermosensitive image transfer ink sheet No. II-15.

Thus, a thermal image transfer recording material No. II-20 composed of the thermosensitive image transfer ink sheet No. II-15 and the image receiving sheet No. 7 according to the present invention was obtained.

EXAMPLE II-21

The thermosensitive image transfer ink sheet No. II-11 obtained in Example II-15 was employed.

The procedure for preparation of the image receiving sheet No. 7 in Example II-15 was repeated except that the o-cresol novolak epoxy resin "EOCN-1020" (Trademark) in the coating liquid K employed in Example II-15 was replaced by phenol novolak epoxy resin "EPPN-201" (Trademark), made by Nippon Kayaku Co., Ltd. (softening point: 68° C.; epoxy equivalent: 187 g/eq), whereby an image receiving sheet No. 9 was prepared.

Thus, a thermal image transfer recording material composed of the thermosensitive image transfer ink sheet No. II-11 and the image receiving sheet No. 9 according to the present invention was obtained.

EXAMPLE II-22

The procedure for preparation of the thermosensitive image transfer ink sheet No. II-1 in Example II-1 was repeated except that 100 parts by weight of o-cresol novolak epoxy resin "EOCN-1020" (Trademark) in the coating liquid D employed in Example II-1 was replaced by a mixture containing 70 parts by weight of bisphenol A epoxy resin "Epicote 1007", made by Yuka Shell Epoxy K.K. (softening point: 128° C.) and 30 parts by weight of modified bisphenol S epoxy resin "EBPS-300" (Trademark), made by Nippon Kayaku Co., Ltd. (softening point: 55° C.), whereby a thermosensitive image transfer ink sheet No. II-16 was prepared.

The image receiving sheet No. 1 obtained in Example II-1 was employed in combination with the above prepared thermosensitive image transfer ink sheet No. II-16.

Thus, a thermal image transfer recording material No. II-22 composed of the thermosensitive image transfer ink sheet No. II-16 and the image receiving sheet No. 1 according to the present invention was prepared.

EXAMPLE II-23

The procedure for preparation of the thermosensitive image transfer ink sheet No. II-1 in Example II-1 was repeated except that 100 parts by weight of o-cresol novolak epoxy resin "EOCN-1020" (Trademark) in the coating liquid D employed in Example II-1 was replaced by a mixture containing 95 parts by weight of o-cresol novolak epoxy resin "EOCN-1020" (softening point: 70.7° C.) and 5 parts by weight of neopentyl glycol diglycidyl ether (boiling point: 98° C.), whereby a thermosensitive image transfer ink sheet No. II-17 was prepared.

The image receiving sheet No. 1 obtained in Example II-1 was employed in combination with the above thermosensitive image transfer ink sheet No. II-17.

Thus, a thermal image transfer recording material No. II-23 composed of the thermosensitive image transfer ink sheet No. II-17 and the image receiving sheet No. 1 according to the present invention was obtained.

EXAMPLE II-24

The procedure for preparation of the thermosensitive image transfer ink sheet No. II-1 in Example II-1 was repeated except that 100 parts by weight of the o-cresol novolak epoxy resin "EOCN-1020" (Trademark) in the coating liquid D employed in Example II-1 was replaced by a mixture containing 40 parts by weight of modified bisphenol S epoxy resin "EBPS-300" (Trademark) (softening point: 55° C.) and 60 parts by weight of carnauba wax "CW-1" (Trademark) (softening point: 73° C.), made by Noda Wax Co., Ltd., whereby a thermosensitive image transfer ink sheet No. II-18 was prepared.

The image receiving sheet No. 1 obtained in Example II-1 was employed in combination with the above thermosensitive image transfer ink sheet No. II-18.

Thus, a thermal image transfer recording material No. II-24 composed of the thermosensitive image transfer ink sheet No. II-18 and the image receiving sheet No. 1 according to the present invention was prepared.

EXAMPLE II-25

The procedure for preparation of the thermosensitive image transfer ink sheet No. II-6 in Example II-8 was repeated except that 100 parts by weight of the o-cresol novolak epoxy resin "EOCN-1020" (Trademark) in the coating liquid G employed in Example II-8 was replaced by a mixture containing 70 parts by weight of bisphenol A epoxy resin "Epicote 1007" (Trademark) (softening point: 128° C.) and 30 parts by weight of modified bisphenol S epoxy resin "EBPS-300" (Trademark) (softening point: 55° C.), whereby a thermosensitive image transfer ink sheet No. II-19 was prepared.

The image receiving sheet No. 4 obtained in Example II-8 was employed in combination with the above thermosensitive image transfer ink sheet No. II-19.

Thus, a thermal image transfer recording material No. II-25 composed of the thermosensitive image transfer ink sheet No. II-19 and the image receiving sheet No. 4 according to the present invention was obtained.

EXAMPLE II-26

The procedure for preparation of the thermosensitive image transfer ink sheet No. II-6 in Example II-8 was repeated except that 100 parts by weight of the o-cresol novolak epoxy resin "EOCN-1020" (Trademark) in the coating liquid G employed in Example II-8 was replaced by a mixture containing 95 parts by weight of o-cresol novolak epoxy resin "EOCN-1020" (Trademark) (softening point: 70.7° C.) and 5 parts by weight of neopentyl glycol diglycidyl ether (boiling point: 98° C.), whereby a thermosensitive image transfer ink sheet No. II-20 was prepared.

The image receiving sheet No. 4 obtained in Example II-8 was employed in combination with the above thermosensitive image transfer ink sheet No. II-20.

Thus, a thermal image transfer recording material No. II-26 composed of the thermosensitive image transfer ink sheet No. II-20 and the image receiving sheet No. 4 according to the present invention was obtained.

EXAMPLE II-27

The procedure for preparation of the thermosensitive image transfer ink sheet No. II-6 in Example II-8 was repeated except that 100 parts by weight of the o-cresol novolak epoxy resin "EOCN-1020" (Trademark) in the coating liquid G employed in Example II-8 was replaced by a mixture containing 40 parts by weight of modified bisphenol S epoxy resin "EBPS-300" (Trademark) (softening point: 55° C.) and 60 parts by weight of carnauba wax "CW-1" (Trademark), made by Noda Wax Co., Ltd., (softening point: 73° C.), whereby a thermosensitive image transfer ink sheet No. II-21 was prepared.

The image receiving sheet No. 4 obtained in Example II-8 was employed in combination with the above thermosensitive image transfer ink sheet No. II-21.

Thus, a thermal image transfer recording material No. II-27 composed of the thermosensitive image transfer ink sheet No. II-21 and the image receiving sheet No. 4 according to the present invention was obtained.

EXAMPLE II-28

The thermosensitive image transfer ink sheet No. II-11 obtained in Example II-15 was employed.

The procedure for preparation of the image receiving sheet No. 7 in Example II-15 was repeated except that 100 parts by weight of the o-cresol novolak epoxy resin "EOCN-1020" (Trademark) in the coating liquid K employed in Example II-15 was replaced by a mixture containing 70 parts by weight of bisphenol A epoxy resin "Epicote 1007" (Trademark) (softening point: 128° C.) and 30 parts by weight of modified bisphenol S epoxy resin "EBPS-300" (Trademark) (softening point: 55° C.), whereby an image receiving sheet No. 10 was prepared.

Thus, a thermal image transfer recording material No. II-28 composed of the thermosensitive image transfer ink sheet No. II-11 and the image receiving sheet No. 10 according to the present invention was obtained.

EXAMPLE II-29

The thermosensitive image transfer ink sheet No. II-11 obtained in Example II-15 was employed.

The procedure for preparation of the image receiving sheet No. 7 in Example II-15 was repeated except that 100 parts by weight of o-cresol novolak epoxy resin "EOCN-1020" (Trademark) in the coating liquid K employed in Example II-15 was replaced by a mixture containing 95 parts by weight of o-cresol novolak epoxy resin "EOCN-1020" (Trademark) (softening point: 70.7° C.) and 5 parts by weight of neopentyl glycol diglycidyl ether (boiling point: 98° C.), whereby an image receiving sheet No. 11 was prepared.

Thus, the thermal image transfer recording material No. II-29 composed of the thermosensitive image transfer ink sheet No. II-11 and the image receiving sheet No. 11 according to the present invention was obtained.

EXAMPLE II-30

The thermosensitive image transfer ink sheet No. II-11 obtained in Example II-15 was employed.

The procedure for preparation of the image receiving sheet No. 7 in Example II-15 was repeated except that 100 parts by weight of the o-cresol novolak epoxy resin "EOCN-1020" (Trademark) in the coating liquid K employed in Example II-15 was replaced by a mixture containing 40 parts by weight of modified bisphenol S epoxy resin "EBPS-300" (Trademark) (softening point: 55° C.) and 60 parts by weight of carnauba wax "CW-1" (Trademark) (softening point: 73° C.), made by Noda Wax Co., Ltd., whereby an image receiving sheet No. 12 was prepared.

Thus, the thermal image transfer recording material No. II-30 composed of the thermosensitive image transfer ink sheet No. II-11 and the image receiving sheet No. 12 according to the present invention was obtained.

COMPARATIVE EXAMPLE II-1

The procedure for preparation of the thermosensitive image transfer ink sheet No. II-1 in Example II-1 was repeated except that the 1,8-diazabicyclo {5,4,0} 7-undecene in the coating liquid C employed in Example II-1 was eliminated, whereby a comparative thermosensitive image transfer ink sheet No. II-1 was prepared.

The image receiving sheet No. 1 obtained in Example II-1 was employed in combination with the above comparative thermosensitive image transfer ink sheet No. II-1.

Thus, a comparative thermal image transfer recording material No. I1-1 composed of the comparative thermosensitive image transfer ink sheet No. II-1 and the image receiving sheet No. 1 was prepared.

COMPARATIVE EXAMPLE II-2

The procedure for preparation of the thermosensitive image transfer ink sheet No. II-1 in Example II-1 was repeated except that the 1,8-diazabicyclo {5,4,0} 7-undecene in the coating liquid C employed in Example II-1 was replaced by benzyl dimethylamine having only one nitrogen atom in the molecule, whereby a comparative thermosensitive image transfer ink sheet No. II-2 was prepared.

The image receiving sheet No. 1 obtained in Example II-1 was employed in combination with the above comparative thermosensitive image transfer sheet No. II-2.

Thus, a comparative thermal image transfer recording material No. II-2 composed of the comparative thermosensitive image transfer ink sheet No. II-2 and the image receiving sheet No. 1 was obtained.

COMPARATIVE EXAMPLE II-3

The thermosensitive image transfer ink sheet No. II-1 obtained in Example II-1 was employed in combination with a mirror coat paper serving as a comparative image receiving sheet No. 1.

Thus, a comparative thermal image transfer recording material No. II-3 composed of the thermosensitive image transfer ink sheet No. II-1 and the comparative image receiving sheet No. 1 was prepared.

COMPARATIVE EXAMPLE II-4

The thermosensitive image transfer ink sheet No. II-1 obtained in Example II-1 was employed.

The procedure for preparation of the image receiving sheet No. 1 in Example II-1 was repeated except that the 1,4-benzenedithiol in the coating liquid E employed in Example II-1 was replaced by 2-mercaptopyridine having only one mercapto group in the molecule (m.p.: 129° C.), whereby a comparative image receiving sheet No. 2 was prepared.

Thus, a comparative thermal image transfer recording material No. II-4 composed of the thermosensitive image transfer ink sheet No. II-1 and the comparative image receiving sheet No. 2 was obtained.

COMPARATIVE EXAMPLE II-5

The procedure for preparation of the thermosensitive image transfer ink sheet No. II-1 in Example II-1 was repeated except that the o-cresol novolak epoxy resin "EOCN-1020" (Trademark) in the coating liquid D employed in Example II-1 was replaced by paraffin wax, whereby a comparative thermosensitive image transfer ink sheet No. II-3 was prepared.

The image receiving sheet No. 1 obtained in Example II-1 was employed in combination with the above comparative thermosensitive image transfer ink sheet No. II-3.

Thus, a comparative thermal image transfer recording material No. II-5 composed of the comparative thermosensitive image transfer ink sheet No. II-3 and the image receiving sheet No. 1 was obtained.

COMPARATIVE EXAMPLE II-6

The procedure for preparation of the thermosensitive image transfer ink sheet No. II-1 in Example II-1 was repeated except that the o-cresol novolak epoxy resin "EOCN-1020" (Trademark) in the coating liquid D employed in Example II-1 was replaced by an epoxy resin with a softening point of 200° C., whereby a comparative thermosensitive image transfer ink sheet No. II-4 was prepared.

The image receiving sheet No. 1 obtained in Example II-1 was employed in combination with the above comparative thermosensitive image transfer ink sheet No. II-4.

Thus, a comparative thermal image transfer recording material No. II-6 composed of the comparative thermosensitive image transfer ink sheet No. II-4 and the image receiving sheet No. 1 was obtained.

COMPARATIVE EXAMPLE II-7

The thermosensitive image transfer ink sheet No. II-1 obtained in Example II-1 was employed.

The procedure for preparation of the image receiving sheet No. 1 in Example II-1 was repeated except that the 1,4,-benzenedithiol in the coating liquid E in Example II-1 was replaced by 1,2-dimercaptobenzene (m.p. 27° C.), whereby a comparative image receiving sheet No. 3 was prepared.

Thus, a comparative thermal image transfer recording material No. II-7 composed of the thermosensitive image transfer ink sheet No. II-1 and the comparative image receiving sheet No. 3 was prepared.

COMPARATIVE EXAMPLE II-8

The thermosensitive image transfer ink sheet No. II-6 obtained in Example II-8 was employed.

The procedure for preparation of the image receiving sheet No. 4 in Example II-8 was repeated except that the 1,8-diazabicyclo{5,4,0}7-undecene in the coating liquid H employed in Example II-8 was eliminated, whereby a comparative image receiving sheet No. 4 was prepared.

Thus, a comparative thermal image transfer recording material No. II-8 composed of the thermosensitive image transfer ink sheet No. II-6 and the comparative image receiving sheet No. 4 was obtained.

COMPARATIVE EXAMPLE II-9

The thermosensitive image transfer ink sheet No. II-6 obtained in Example II-8 was employed.

The procedure for preparation of the image receiving sheet No. 4 in Example II-8 was repeated except that the 1,8-diazabicyclo{5,4,0}7-undecene in the coating liquid H employed in Example II-8 was replaced by benzyl dimethylamine having only one nitrogen atom in the molecule, whereby a comparative image receiving sheet No. 5 was prepared.

Thus, a thermal image transfer recording material No. II-9 composed of the thermosensitive image transfer ink sheet No. II-6 and the comparative image receiving sheet No. 5 was obtained.

COMPARATIVE EXAMPLE II-10

The procedure for preparation of the thermosensitive image transfer ink sheet No. II-6 in Example II-8 was repeated except that the coating liquid F employed in Example II-8 was not coated on the support, whereby a comparative thermosensitive image transfer ink sheet No. II-5 was prepared.

The image receiving sheet No. 4 obtained in Example II-8 was employed in combination with the above comparative thermosensitive image transfer ink sheet No. II-5.

Thus, a comparative thermal image transfer recording material No. II-10 composed of the comparative thermosensitive image transfer ink sheet No. II-5 and the image receiving sheet No. 4 was obtained.

COMPARATIVE EXAMPLE II-11

The procedure for preparation of the thermosensitive image transfer ink sheet No. II-6 in Example II-8 was repeated except that the 1,4-benzenedithiol in the coating liquid F employed in Example II-8 was replaced by 2-mercaptopyridine having only one mercapto group in the molecule (m.p. 129° C.), whereby a comparative thermosensitive image transfer ink sheet No. II-6 was prepared.

The image receiving sheet No. 4 obtained in Example II-8 was employed in combination with the above comparative thermosensitive image transfer ink sheet No. II-6.

Thus, a comparative thermal image transfer recording material No. II-11 composed of the comparative thermosensitive image transfer ink sheet No. II-6 and the image receiving sheet No. 4 was obtained.

COMPARATIVE EXAMPLE II-12

The procedure for preparation of the thermosensitive image transfer ink sheet No. II-6 in Example II-8 was repeated except that the o-cresol novolak epoxy resin "EOCN-1020" (Trademark) in the coating liquid G employed in Example II-8 was replaced by paraffin wax, whereby a comparative thermosensitive image transfer ink sheet No. II-7 was prepared.

The image receiving sheet No. 4 obtained in Example II-8 was employed in combination with the above comparative thermosensitive image transfer ink sheet No. II-7.

Thus, a comparative thermal image transfer recording material No. II-12 composed of the comparative thermosensitive image transfer ink sheet No. II-7 and the image receiving sheet No. 4 was obtained.

COMPARATIVE EXAMPLE II-13

The procedure for preparation of the thermosensitive image transfer ink sheet No. II-6 in Example II-8 was repeated except that the o-cresol novolak epoxy resin "EOCN-1020" (Trademark) in the coating liquid G employed in Example II-8 was replaced by an epoxy resin with a softening point of 200° C., whereby a comparative thermosensitive image transfer ink sheet No. II-8 was prepared.

The image receiving sheet No. 4 obtained in Example II-8 was employed in combination with the above comparative thermosensitive image transfer ink sheet No. II-8.

Thus, a comparative thermal image transfer recording material No. II-13 composed of the comparative thermosensitive image transfer ink sheet No. II-8 and the image receiving sheet No. 4 was obtained.

COMPARATIVE EXAMPLE II-14

The procedure for preparation of the thermosensitive image transfer ink sheet No. II-6 in Example II-8 was repeated except that the 1,4,-benzenedithiol in the coating liquid F in Example II-8 was replaced by 1,2-dimercaptobenzene (m.p. 27° C.), whereby a comparative thermosensitive image transfer ink sheet No. II-9 was prepared.

The image receiving sheet No. 4 obtained in Example II-8 was employed in combination with the above comparative thermosensitive image transfer ink sheet No. II-9.

Thus, a comparative thermal image transfer recording material No. II-14 composed of the comparative thermosensitive image transfer ink sheet No. II-9 and the image receiving sheet No. 4 was obtained.

COMPARATIVE EXAMPLE II-15

The procedure for preparation of the thermosensitive image transfer ink sheet No. II-11 in Example II-15 was repeated except that the 1,8-diazabicyclo {5,4,0}7-undecene in the coating liquid I employed in Example II-15 was eliminated, whereby a comparative thermosensitive image transfer ink sheet No. II-10 was prepared.

The image receiving sheet No. 7 obtained in Example II-15 was employed in combination with the above comparative thermosensitive image transfer ink sheet No. II-10.

Thus, a comparative thermal image transfer recording material No. II-15 composed of the comparative thermosensitive image transfer ink sheet No. II-10 and the image receiving sheet No. 7 was obtained.

COMPARATIVE EXAMPLE II-16

The procedure for preparation of the thermal image transfer ink sheet No. II-11 in Example II-15 was repeated except that the 1,8-diazabicyclo {5,4,0}7-undecene in the coating liquid I employed in Example II-15 was replaced by benzyl dimethylamine having only one nitrogen atom in the molecule, whereby a comparative thermosensitive image transfer ink sheet No. II-11 was prepared.

The image receiving sheet No. 7 obtained in Example II-15 was employed in combination with the above comparative thermosensitive image transfer ink sheet No. II-11.

Thus, a comparative thermal image transfer recording material No. II-16 composed of the comparative thermosensitive image transfer ink sheet No. II-11 and the image receiving sheet No. 7 was obtained.

COMPARATIVE EXAMPLE II-17

The thermosensitive image transfer ink sheet No. II-11 obtained in Example II-15 was employed in combination with a mirror coat paper serving as a comparative image receiving sheet No. 6.

Thus, a comparative thermal image transfer recording material No. II-17 composed of the thermosensitive image transfer ink sheet No. II-11 and the comparative image receiving sheet No. 6 was prepared.

COMPARATIVE EXAMPLE II-18

The procedure for preparation of the thermosensitive image transfer ink sheet No. II-11 in Example II-15 was repeated except that the 1,4-benzenedithiol in the coating liquid J employed in Example II-15 was replaced by 2-mercaptopyridine having only one mercapto group in the molecule (m.p. 129° C.), whereby a comparative thermosensitive image transfer ink sheet No. II-12 was prepared.

The image receiving sheet No. 7 obtained in Example II-15 was employed in combination with the above comparative thermosensitive image transfer ink sheet No. II-12.

Thus, a comparative thermal image transfer recording material No. II-18 composed of the comparative thermosensitive image transfer ink sheet No. II-12 and the image receiving sheet No. 7 was obtained.

COMPARATIVE EXAMPLE II-19

The thermosensitive image transfer ink sheet No. II-11 obtained in Example II-15 was employed.

The procedure for preparation of the image receiving sheet No. 7 in Example II-15 was repeated except that the o-cresol novolak epoxy resin "EOCN-1020" (Trademark) in the coating liquid K employed in Example II-15 was replaced by paraffin wax, whereby a comparative image receiving sheet No. 7 was prepared.

Thus, a comparative thermal image transfer recording material No. II-19 composed of the thermosensitive image transfer ink sheet No. II-11 and the comparative image receiving sheet No. 7 was prepared.

COMPARATIVE EXAMPLE II-20

The thermosensitive image transfer ink sheet No. II-11 obtained in Example II-15 was employed.

The procedure for preparation of the image receiving sheet No. 7 in Example II-15 was repeated except that the o-cresol novolak epoxy resin "EOCN-1020" (Trademark) in the coating liquid K employed in Example II-15 was replaced by an epoxy resin with a softening point of 200° C., whereby a comparative image receiving sheet No. 8 was prepared.

Thus, a comparative thermal image transfer recording material No. II-20 composed of the thermosensitive image transfer ink sheet No. II-11 and the comparative image receiving sheet No. 8 was obtained.

COMPARATIVE EXAMPLE II-21

The procedure for preparation of the thermosensitive image transfer ink sheet No. II-11 in Example II-15 was repeated except that the 1,4,-benzenedithiol in the coating liquid J in Example II-15 was replaced by 1,2-dimercaptobenzene (m.p. 27° C.), whereby a comparative thermosensitive image transfer ink sheet No. II-13 was prepared.

The image receiving sheet No. 7 obtained in Example II-15 was employed in combination with the above comparative thermosensitive image transfer ink sheet No. II-13.

Thus, a comparative thermal image transfer recording material No. II-21 composed of the comparative thermosensitive image transfer ink sheet No. II-13 and the image receiving sheet No. 7 was obtained.

Image formation was conducted by use of each of the above obtained thermosensitive image transfer ink sheets Nos. I-1 to I-5 according to the present invention, the comparative thermosensitive image transfer ink sheets Nos. I-1 to I-6, the thermal image transfer recording materials Nos. II-1 to II-30 according to the present invention, and the comparative thermal image transfer recording materials Nos. II-1 to II-21.

For the thermosensitive image transfer ink sheets Nos. I-1 to I-5, and the comparative thermosensitive image transfer ink sheets Nos. I-1 to I-6, a mirror coat paper in the form of a label with an adhesive layer at the back thereof was used as an image receiving sheet.

Furthermore, for the thermal image transfer recording materials Nos. II-1 to II-30, and the comparative thermal image transfer recording materials No. II-1 to II-21, the image receiving sheets respectively obtained in Examples II-1 to II-30 and Comparative Examples II-1 to II-21 were employed, which were in the same shape as that for the mirror coat paper for the above-mentioned thermosensitive image transfer ink sheets, with an adhesive layer on the back side of each image receiving sheet.

In order to evaluate the thermosensitivity, resistance to solvents and chemicals, heat resistance, and frictional resistance of each of the above obtained thermosensitive image transfer ink sheets Nos. I-1 to I-5 according to the present invention, the comparative thermosensitive image transfer ink sheets Nos. I-1 to I-6, the thermal image transfer recording materials Nos. II-1 to II-30 according to the present invention, and the comparative thermal image transfer recording materials Nos. II-1 to II-21, thermal printing was conducted under the following conditions:

| | |
|---|---|
| Thermal head employed: | Partially grazed thermal head of a thin type |
| Platen pressure: | 150 gf/cm |
| Peeling angle of thermosensitive image transfer ink sheet with respect to an image receiving sheet: | 30° |
| Torque value when each thermosensitive image transfer ink sheet is peeled from an image receiving sheet: | 200 g |
| Energy applied from thermal head: | 10 to 35 mJ/mm$^2$ |
| Printing speed: | 4 inches/sec |
| Printing image: | "Code 3/9" bar code |

The thermosensitivity of each of the above obtained thermosensitive image transfer ink sheets and thermal image transfer recording materials, and the resistance to solvents and chemicals, heat resistance, and frictional resistance of an image obtained under the above conditions by each of the above obtained thermosensitive image transfer ink sheets and the thermal image transfer recording materials were evaluated in accordance with the following evaluation standards:

1. Thermosensitivity:

The thermosensitivity of each of the above thermosensitive image transfer ink sheets and thermal image transfer recording materials was determined by a minimum energy (mJ/cm$^2$) required for producing a bar code image with a reading ratio of 100%.

2. Resistance to solvents and chemicals:

Each bar code printed on each image receiving sheet was rubbed with an applicator covered with cotton at the top portion thereof, with the cotton portion soaked with one of the following solvents and chemicals in an amount of 0.5 ml and with the application of a load of 30 g/cm$^2$, until the surface of the image receiving sheet was exposed:

Ethanol, brake oil, kerosine, toluene, xylene and perchloroethylene.

The resistance to solvents and chemicals of each printed bar code image was determined by the number of rubbing times at which the printed bar code was erased and the surface of the image receiving sheet was exposed.

3. Heat resistance:

Each printed bar code bearing image receiving sheet was rubbed by a corrugated cardboard with the application of a load of 100 g/cm$^2$ in an atmosphere at 100° C., with the corrugated cardboard being reciprocated at a rate of 30 cm/sec, until the bar code images became illegible. The heat resistance was determined by the number of the reciprocation of the rubbing at which the bar code images became illegible.

4. Frictional resistance:

Each printed bar code bearing image receiving sheet was rubbed by a material having a hardness of 2 H with the application of a load of about 1 t/cm$^2$, with the material being reciprocated until the bar code images became illegible. The frictional resistance was determined by the number of the reciprocation of the rubbing at which the bar code images became illegible.

The results of the above tests are shown in Table 1.

TABLE 1

| | Thermosensitivity (mJ/mm$^2$) | Resistance to Solvents and Chemicals | | | | | | Heat Resistance | Frictional Resistance |
|---|---|---|---|---|---|---|---|---|---|
| | | Ethanol | Brake Oil | Kerosine | Toluene | Xylene | Perchloroethylene | | |
| Ex. I-1 | 17 | 81 | >100 | >100 | 88 | >100 | 78 | >100 | >100 |
| Ex. I-2 | 18 | 85 | >100 | >100 | 91 | >100 | 74 | >100 | >100 |
| Ex. I-3 | 17 | 78 | >100 | >100 | 83 | >100 | 81 | >100 | >100 |
| Ex. I-4 | 16 | 86 | >100 | >100 | 87 | >100 | 81 | >100 | >100 |
| Ex. I-5 | 18 | 82 | >100 | >100 | 85 | >100 | 79 | >100 | >100 |
| Comp. Ex. I-1 | 19 | 70 | 30 | 44 | 23 | 81 | 22 | 75 | 72 |
| Comp. Ex. I-2 | 17 | 65 | 37 | 51 | 31 | 79 | 34 | 79 | 77 |
| Comp. | 18 | 53 | 28 | 42 | 26 | 73 | 27 | 66 | 74 |

TABLE 1-continued

| | Thermosensitivity ($mJ/mm^2$) | Resistance to Solvents and Chemicals | | | | | | Heat Resistance | Frictional Resistance |
|---|---|---|---|---|---|---|---|---|---|
| | | Ethanol | Brake Oil | Kerosine | Toluene | Xylene | Perchloroethylene | | |
| Ex. I-3 | | | | | | | | | |
| Comp. | 17 | 55 | 30 | 43 | 27 | 78 | 31 | 83 | 78 |
| Ex. I-4 | | | | | | | | | |
| Comp. | 13 | 41 | 22 | 33 | 19 | 24 | 26 | 13 | 38 |
| Ex. I-5 | | | | | | | | | |
| Comp. | 25 | 70 | 83 | 86 | 78 | 88 | 71 | 89 | 81 |
| Ex. I-6 | | | | | | | | | |
| Ex. II-1 | 17 | 81 | >100 | >100 | 88 | >100 | 78 | >100 | >100 |
| Ex. II-2 | 18 | 85 | >100 | >100 | 91 | >100 | 74 | >100 | >100 |
| Ex. II-3 | 17 | 78 | >100 | >100 | 83 | >100 | 81 | >100 | >100 |
| Ex. II-4 | 16 | 86 | >100 | >100 | 87 | >100 | 81 | >100 | >100 |
| Ex. II-5 | 18 | 82 | >100 | >100 | 85 | >100 | 79 | >100 | >100 |
| Ex. II-6 | 17 | 85 | >100 | >100 | 91 | >100 | 74 | >100 | >100 |
| Ex. II-7 | 17 | 78 | >100 | >100 | 83 | >100 | 81 | >100 | >100 |
| Ex. II-8 | 16 | 86 | >100 | >100 | 87 | >100 | 81 | >100 | >100 |
| Ex. II-9 | 18 | 81 | >100 | >100 | 83 | >100 | 78 | >100 | >100 |
| Ex. II-10 | 17 | 85 | >100 | >100 | 87 | >100 | 74 | >100 | >100 |
| Ex. II-11 | 17 | 78 | >100 | >100 | 85 | >100 | 81 | >100 | >100 |
| Ex. II-12 | 18 | 86 | >100 | >100 | 91 | >100 | 79 | >100 | >100 |
| Ex. II-13 | 17 | 85 | >100 | >100 | 85 | >100 | 74 | >100 | >100 |
| Ex. II-14 | 16 | 78 | >100 | >100 | 91 | >100 | 81 | >100 | >100 |
| Ex. II-15 | 18 | 86 | >100 | >100 | 83 | >100 | 79 | >100 | >100 |
| Ex. II-16 | 17 | 85 | >100 | >100 | 83 | >100 | 81 | >100 | >100 |
| Ex. II-17 | 18 | 78 | >100 | >100 | 87 | >100 | 81 | >100 | >100 |
| Ex. II-18 | 17 | 86 | >100 | >100 | 85 | >100 | 78 | >100 | >100 |
| Ex. II-19 | 16 | 81 | >100 | >100 | 91 | >100 | 81 | >100 | >100 |
| Ex. II-20 | 17 | 85 | >100 | >100 | 85 | >100 | 79 | >100 | >100 |
| Ex. II-21 | 18 | 78 | >100 | >100 | 91 | >100 | 74 | >100 | >100 |
| Ex. II-22 | 17 | 81 | >100 | >100 | 88 | >100 | 78 | >100 | >100 |
| Ex. II-23 | 15 | 82 | >100 | >100 | 85 | >100 | 79 | >100 | >100 |
| Ex. II-24 | 17 | 78 | >100 | >100 | 83 | >100 | 81 | >100 | >100 |
| Ex. II-25 | 16 | 86 | >100 | >100 | 87 | >100 | 81 | >100 | >100 |
| Ex. II-26 | 15 | 86 | >100 | >100 | 91 | >100 | 79 | >100 | >100 |
| Ex. II-27 | 16 | 78 | >100 | >100 | 91 | >100 | 81 | >100 | >100 |
| Ex. II-28 | 18 | 86 | >100 | >100 | 83 | >100 | 79 | >100 | >100 |
| Ex. II-29 | 15 | 81 | >100 | >100 | 91 | >100 | 81 | >100 | >100 |
| Ex. II-30 | 18 | 78 | >100 | >100 | 91 | >100 | 74 | >100 | >100 |
| Comp. | 18 | 70 | 30 | 44 | 23 | 81 | 22 | 75 | 72 |
| Ex. II-1 | | | | | | | | | |
| Comp. | 17 | 65 | 37 | 51 | 31 | 79 | 34 | 79 | 77 |
| Ex. II-2 | | | | | | | | | |
| Comp. | 18 | 13 | 11 | 21 | 26 | 24 | 27 | 10 | 13 |
| Ex. II-3 | | | | | | | | | |
| Comp. | 17 | 24 | 30 | 25 | 27 | 35 | 31 | 27 | 31 |
| Ex. II-4 | | | | | | | | | |
| Comp. | 13 | 41 | 22 | 33 | 19 | 24 | 26 | 13 | 11 |
| Ex. II-5 | | | | | | | | | |
| Comp. | 25 | 70 | 83 | 86 | 78 | 88 | 71 | 89 | 81 |
| Ex. II-6 | | | | | | | | | |
| Comp. | 18 | 21 | 27 | 21 | 24 | 31 | 25 | 21 | 29 |
| Ex. II-7 | | | | | | | | | |
| Comp. | 18 | 68 | 31 | 45 | 25 | 80 | 21 | 74 | 71 |
| Ex. II-8 | | | | | | | | | |
| Comp. | 17 | 67 | 35 | 51 | 32 | 78 | 34 | 77 | 75 |
| Ex. II-9 | | | | | | | | | |
| Comp. | 17 | 13 | 11 | 21 | 26 | 24 | 26 | 10 | 13 |
| Ex. II-10 | | | | | | | | | |
| Comp. | 17 | 25 | 32 | 26 | 29 | 33 | 32 | 26 | 29 |
| Ex. II-11 | | | | | | | | | |
| Comp. | 13 | 42 | 23 | 34 | 17 | 24 | 27 | 13 | 11 |
| Ex. II-12 | | | | | | | | | |
| Comp. | 25 | 71 | 81 | 84 | 77 | 86 | 73 | 87 | 81 |
| Ex. II-13 | | | | | | | | | |
| Comp. | 18 | 20 | 31 | 21 | 24 | 31 | 25 | 21 | 29 |
| Ex. II-14 | | | | | | | | | |
| Comp. | 18 | 69 | 32 | 41 | 21 | 83 | 24 | 76 | 71 |
| Ex. II-15 | | | | | | | | | |
| Comp. | 17 | 64 | 36 | 52 | 32 | 78 | 36 | 78 | 77 |
| Ex. II-16 | | | | | | | | | |
| Comp. | 17 | 13 | 11 | 19 | 27 | 22 | 24 | 11 | 11 |
| Ex. II-17 | | | | | | | | | |
| Comp. | 17 | 26 | 32 | 25 | 24 | 34 | 32 | 27 | 31 |
| Ex. II-18 | | | | | | | | | |
| Comp. | 18 | 39 | 24 | 34 | 17 | 24 | 26 | 13 | 11 |
| Ex. II-19 | | | | | | | | | |
| Comp. | 16 | 72 | 81 | 86 | 74 | 82 | 73 | 87 | 79 |
| Ex. II-20 | | | | | | | | | |
| Comp. | 18 | 21 | 27 | 23 | 21 | 32 | 25 | 21 | 27 |

TABLE 1-continued

| | Thermosensitivity ($mJ/mm^2$) | Resistance to Solvents and Chemicals | | | | | | Heat Resistance | Frictional Resistance |
|---|---|---|---|---|---|---|---|---|---|
| | | Ethanol | Brake Oil | Kerosine | Toluene | Xylene | Perchloroethylene | | |
| Ex. II-21 | | | | | | | | | |

As can be seen from the above results in Table 1, each of the thermosensitive image transfer ink sheets and the thermal image transfer recording materials according to the present invention is capable of producing images with much better thermosensitivity, heat resistance, resistance to solvents and chemicals, and frictional resistance even with the application of a small amount of energy thereto in comparison with the conventional comparative thermosensitive image transfer ink sheets and thermal image transfer recording materials.

What is claimed is:

1. A thermosensitive image transfer ink sheet comprising:

a support, and a thermofusible coloring layer formed on said support, comprising a coloring agent, an epoxy resin, a mercapto-group-containing compound serving as an epoxy resin crosslinking agent, and a tertiary amine or a salt thereof serving as a crosslinking reaction promoting agent.

2. A thermosensitive image transfer ink sheet as claimed in claim 1, wherein said thermofusible coloring layer comprises two layers, with said coloring agent being contained at least in one of said two layers, each of said epoxy resin and said mercapto-group-containing compound being contained in different layers of said two layers, and said tertiary amine or said salt thereof being contained in at least one of said two layers.

3. The thermosensitive image transfer ink sheet as claimed in claim 2, wherein said epoxy resin comprises an epoxy resin component with a softening point or melting point of less than 60° C. and an epoxy resin component with a softening point or melting point of 111° C. or more.

4. The thermosensitive image transfer ink sheet as claimed in claim 2, wherein said epoxy resin comprises an epoxy resin component with a softening point or melting point in the range of 50° C. to 120° C. and an epoxy compound with a boiling point in the range of 80° C. to 200° C.

5. The thermosensitive image transfer ink sheet as claimed in claim 4, wherein said epoxy compound with a boiling point in the range of 80° C. to 200° C. is contained in an amount of 1 wt. % to 10 wt. % of the entire weight of said epoxy resin in said thermofusible coloring layer.

6. The thermosensitive image transfer ink sheet as claimed in claim 1, wherein said thermofusible coloring layer comprises three layers, with said coloring agent being contained at least in one of said three layers, each of said epoxy resin, said mercapto-group-containing compound, and said tertiary amine or said salt thereof being contained in a different layer of said three layers.

7. The thermosensitive image transfer ink sheet as claimed in claim 6, wherein said epoxy resin comprises an epoxy resin component with a softening point or melting point of less than 60° C. and an epoxy resin component with a softening point or melting point of 111° C. or more.

8. The thermosensitive image transfer ink sheet as claimed in claim 6, wherein said epoxy resin comprises an epoxy resin component with a softening point or melting point in the range of 50° C. to 120° C. and an epoxy compound with a boiling point in the range of 80° C. to 200° C.

9. The thermosensitive image transfer ink sheet as claimed in claim 8, wherein said epoxy compound with a boiling point in the range of 80° C. to 200° C. is contained in an amount of 1 wt. % to 10 wt. % of the entire weight of said epoxy resin in said thermofusible coloring layer.

10. The thermosensitive image transfer ink sheet as claimed in claim 1, wherein said epoxy resin comprises an epoxy resin component with a softening point or melting point of less than 60° C. and an epoxy resin component with a softening point or melting point of 111° C. or more.

11. The thermosensitive image transfer ink sheet as claimed in claim 10, wherein said epoxy resin component with a softening point or melting point of less than 60° C. is contained in an amount of 5 wt. % to 35 wt. % of the entire weight of said epoxy resin in said thermofusible coloring layer.

12. The thermosensitive image transfer ink sheet as claimed in claim 10, wherein said thermofusible coloring layer further comprises a wax with a melting point of 75° C. or more.

13. The thermosensitive image transfer ink sheet as claimed in claim 12, wherein said epoxy resin with a softening point of less than 60° C. is contained in an amount of 25 wt. % to 55 wt. % of the entire weight of said thermofusible ink layer except for the weight of said coloring agent.

14. The thermosensitive image transfer ink sheet as claimed in claim 1, wherein said epoxy resin comprises an epoxy resin component with a softening point or melting point in the range of 50° C. to 120° C. and an epoxy compound with a boiling point in the range of 80° C. to 200° C.

15. The thermosensitive image transfer ink sheet as claimed in claim 14, wherein said epoxy compound with a boiling point in the range of 80° C. to 200° C. is contained in an amount of 1 wt. % to 10 wt. % of the entire weight of said epoxy resin in said thermofusible coloring layer.

* * * * *